US005247713A

United States Patent [19]

Larson

[11] Patent Number: 5,247,713

[45] Date of Patent: Sep. 28, 1993

[54] WATERBED MATTRESS LINER TRAY

[76] Inventor: Lynn D. Larson, 1052 N. Lakeshore Dr., Lincoln, Nebr. 68528

[21] Appl. No.: 851,034

[22] Filed: Mar. 13, 1992

[51] Int. Cl.[5] ..... A47C 27/08

[52] U.S. Cl. ..... 5/400; 5/451; 5/917

[58] Field of Search ..... 5/451, 450, 452, 400, 5/422, 606, 917, 918

[56] References Cited

U.S. PATENT DOCUMENTS

| | | | |
|---|---|---|---|
| 3,724,008 | 4/1973 | Golden | 5/451 |
| 3,732,585 | 5/1973 | Krehbiel | 5/451 |
| 4,413,367 | 4/1983 | Miller et al. | 5/451 |
| 4,745,646 | 5/1988 | Strobel | 5/451 |
| 4,932,088 | 6/1990 | Johenning et al. | 5/451 |
| 5,027,453 | 7/1991 | Koenig | 5/451 |
| 5,068,935 | 12/1991 | Hagopian | 5/451 |
| 5,144,707 | 4/1992 | Callaway et al. | 5/451 |

*Primary Examiner*—Alexander Grosz

*Attorney, Agent, or Firm*—Law Offices of John A. Beehner

[57] ABSTRACT

A waterbed mattress liner tray includes a bottom wall, headwall, footwall and opposite sidewalls integrally formed into an open-topped water retaining tray. Each sidewall is formed with a spring portion which is compressible under a downward load but which is spring biased to expand to its normal height upon removal of the downward load so as to provide the support characteristics of a soft side waterbed. The bottom wall may be contoured to form riser sections for varying the support for different body parts of a sleeper. Longitudinal channels extend across the riser sections to afford drainage thereacross.

26 Claims, 2 Drawing Sheets

WATERBED MATTRESS LINER TRAY

BACKGROUND OF THE INVENTION

The present invention is directed generally to a formed waterbed mattress liner tray having spring-like collapsible sidewalls and footwall to receive and support a waterbed mattress in a manner simulating a soft side waterbed. The invention is furthermore directed to such a tray having a contoured bottom wall to adjust the support in different areas of the waterbed mattress to correspond to different body parts. Channels extend longitudinally across contoured riser sections to afford drainage of water to one end of the tray.

Waterbed mattress liner trays are known in the art to provide added assurance against leaks in a waterbed mattress or flexible liner. The liner trays are generally formed of somewhat rigid plastic and with upright sidewalls having little or no vertical compressibility. Such a tray is generally placed within a hard sided waterbed frame to prevent a sleeper from sitting upon the thin upright sidewall of the tray.

Many waterbed users prefer a soft side waterbed because it is easier to get on and off of and because like a conventional mattress and can be used with conventional bed linens. Liner trays with sidewalls extending to the top of the waterbed mattress are unusable in soft side waterbeds because they would interfere with depression of a sidewall when a sleeper sits on one edge of the bed.

Conventional soft side waterbeds generally include a full peripheral compressible support wall which has load bearing characteristics different from the waterbed mattress itself and which reduces the surface area of the waterbed mattress. Tall individuals may necessarily have their head and feet supported on a foam sidewall due to the shortened length of the waterbed mattress itself.

Accordingly, a primary object of the present invention is to provide an improved waterbed mattress liner tray.

Another object is to provide a waterbed mattress liner tray wherein at least each sidewall includes a collapsible wall portion which will collapse under a downward load and expand back to full height upon removal of the load.

Another object is to provide such a waterbed mattress liner tray having a bellows-like spring sidewall.

Another object is to provide such a waterbed mattress liner tray wherein the sidewall includes an upwardly and outwardly inclined portion which cooperates with an adjacent mechanical insulator block to provide collapsible resilient support along each sidewall.

Another object is to provide such a waterbed mattress liner tray having a contoured bottom surface to vary the support for different body parts of a sleeper.

Another object is to provide such a water bed mattress liner tray having a contoured bottom wall with channels therethrough to provide drainage toward one portion of the tray.

Another object is to provide a waterbed mattress liner tray which is simple and rugged in construction, economical to manufacture and efficient and comfortable in use.

SUMMARY OF THE INVENTION

The waterbed mattress liner tray of the present invention includes a bottom wall, headwall, footwall and opposite sidewalls connected together to form an open-topped water retaining tray adapted for receiving and supporting a waterbed mattress on the bottom wall and between the other walls. At least each sidewall, and perhaps the footwall as well, include a compressible wall portion inclined at an acute angle to vertical so as to be collapsible under a downward load such as when a sleeper sits on the edge of the bed. Each sidewall may be formed as a bellows-like spring including a pleated panel which is collapsible from a normal expanded height to a shortened compressed height and which is spring biased to the normal expanded height thereof. A mechanical insulator such as foam preferably overlies the top edge of each sidewall and footwall to prevent the sleeper from feeling these walls.

An alternative to the bellows-like spring sidewall is a sidewall having an upwardly and outwardly inclined lower portion which merges with an upright upper portion secured to a foam block or the like so that when a downward load is placed on the upper portion, the inclined lower portion of the sidewall enables depression of the sidewall with compression of the foam block, thereby providing the characteristics of a soft side waterbed. The upper edge of the sidewall may terminate in an outward flange receivable within a slit on the interior side of the foam block. The foam block may have an exterior slot to accommodate receipt of bed linen.

The waterbed mattress liner tray bottom wall may be contoured to vary the support provided for different body parts of a sleeper. The contoured bottom wall forms at least one riser section and at least one channel extended longitudinally across the length of the riser section for drainage of water thereacross. Each riser section will generally extend transversely substantially across the bottom wall and several longitudinal channels may be formed, such as adjacent each sidewall and through the center of the riser section. Riser sections would typically be placed across the middle of the tray for lumbar support and at the head and foot ends of the tray, although many different arrangements may be provided to accommodate different patterns of support. The portion of the bottom wall excluding the riser sections is generally planar and may slope toward a drain well.

DESCRIPTION OF THE PREFERRED EMBODIMENTS

Figure 1:
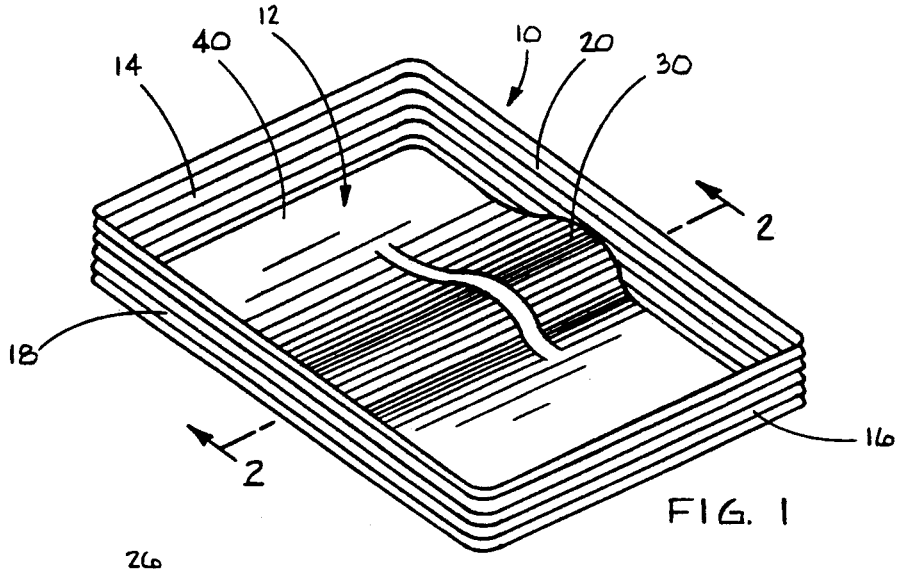
FIG. 1 is a perspective view of one embodiment of the invention including bellows-like spring sidewalls.

The waterbed mattress liner tray 10 of the present invention is illustrated in FIGS. 1–5 as including a bottom wall 12, headwall 14, footwall 16 and opposite sidewalls 18 and 20, all connected together to form an open-topped water retaining tray adapted for receiving and supporting a waterbed mattress on the bottom wall and between the other walls. The liner tray 10 is preferably vacuum thermoformed so that all of the walls are integral portions of a unitary tray.

Figure 2:
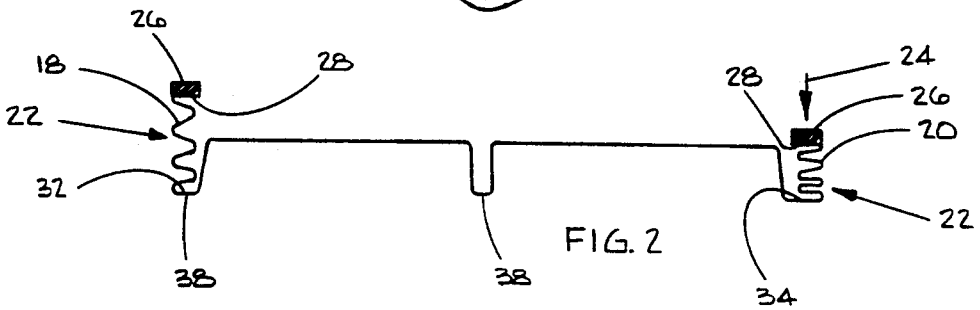
FIG. 2 is a sectional view of the waterbed mattress liner tray, taken along line 2—2 in FIG. 1.
Figure 6:
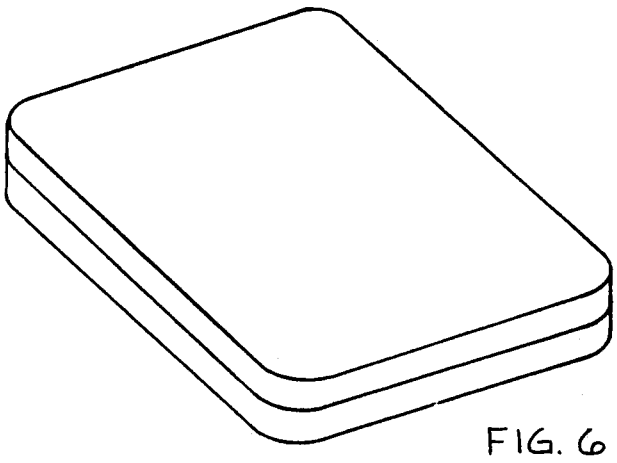
FIG. 6 is a perspective view of the waterbed mattress liner tray including a waterbed mattress and a cover over the liner and mattress.

In the embodiment of FIGS. 1–5, the sidewalls 18 and 20, and headwall 14 and footwall 16 as well, are bellows-like springs in the form of a pleated panel 22. In cross section, the pleats of panel 22 may be generally sine wave curves as shown in FIG. 2 or generally flat oppositely inclined pleats. In either event, the sidewall including the pleated panel 22 is collapsible from a normal expanded height, as illustrated on the left side of FIG. 2, to a shortened compressed height, as illustrated on the right side of FIG. 2, when subjected to a downward load indicated by arrow 24. The sidewall is spring biased to the normal expanded height thereof. The bellows-like spring panel preferably extends vertically substantially throughout the height of the sidewall.

A mechanical insulator such as a strip of foam, fiber or the like preferably overlies the top edge of each sidewall and footwall so that these walls are not felt by one sitting on the edge of the bed. Each sidewall 18 and 20 and footwall 16 preferably terminates at its upper edge in a generally horizontal flange 28 which extends inwardly as shown in FIG. 2. The mechanical insulator strip 26 may be secured by adhesives or any other fasteners to the flange 28.

Figure 5:
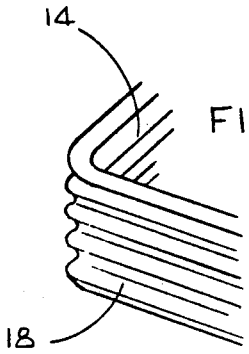
FIG. 5 is a partial perspective view of one corner of the waterbed mattress liner tray of FIG. 1.

The four corners of the liner tray are preferably rounded as illustrated in FIG. 5 so that the pleats of the sidewalls register and merge with the pleats of the headwall 14 or footwall 16 in an arcuate pattern much like a quarter section of a cylindrical bellows spring.

Figure 3:
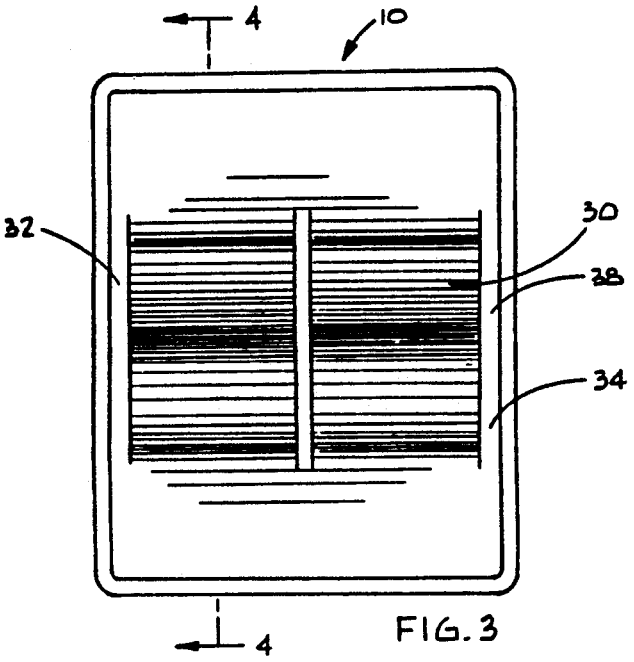
FIG. 3 is a top plan view of the waterbed mattress liner tray of FIG. 1.
Figure 4:
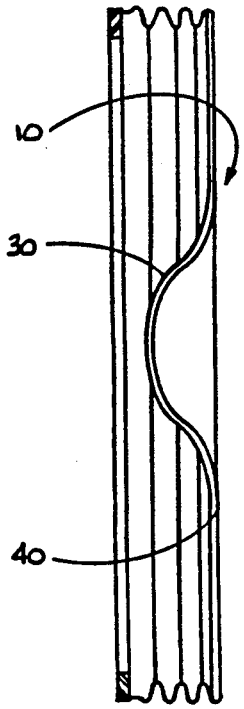
FIG. 4 is a side sectional view taken along line 4—4 in FIG. 3.

Referring to FIGS. 1–4, bottom wall 12 is contoured to form a generally centrally positioned riser section 30 which, in longitudinal cross section as illustrated in FIG. 4, has a generally shallow bell-shaped curve shape. A shallower area of water is thus provided under the lumbar portion of a sleeper for added support in that area. Additional riser sections could be provided at the head and foot ends of the bottom wall 12, for example, to decrease the water in the mattress and provide added support at those areas. The pattern of riser sections may be varied to accommodate any particular patterns of support for a sleeper on the waterbed mattress.

It is generally preferred that the riser section 30 extends transversely substantially across the bottom wall 12. To afford drainage of water longitudinally across a riser section, at least one channel is formed in the riser section and bottom wall to longitudinally span the riser section. FIGS. 2 and 3 illustrate side channels 32 and 34 immediately adjacent sidewalls 18 and 20 respectively, and a center channel 36 generally centered between sidewalls 18 and 20.

Figure 10:
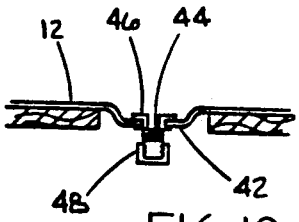
FIG. 10 is a side sectional view illustrating a drain well through the bottom wall of the tray.

It is preferred that the bottom wall 12, excluding the riser sections 30, is generally planar and each channel includes a bottom surface 38 which is generally coplanar with the generally planar portion 40 of bottom wall 12. The planar portion 40 need not be perfectly flat and may have domes, ridges or grooves formed therein but all of the lowest portions of the bottom wall, excluding any drain well, preferably lie in a common plane and are referred to herein as the planar portion of the bottom wall. Just as the bottom wall need not be flat, it likewise need not be horizontal. It may be advantageous to form a slight head to toe incline across the length of the bottom wall 12 to facilitate drainage from the headwall 14 to the footwall 16 or visa versa. FIG. 10 illustrates a sunken recess 42 which may be formed in bottom wall 12 to provide a drainage well equipped with a closable drain opening 44. The illustrated opening includes a threaded collar 46 and a threaded closure cap 48 but any other type of valve or closure could be substituted.

Figure 7:
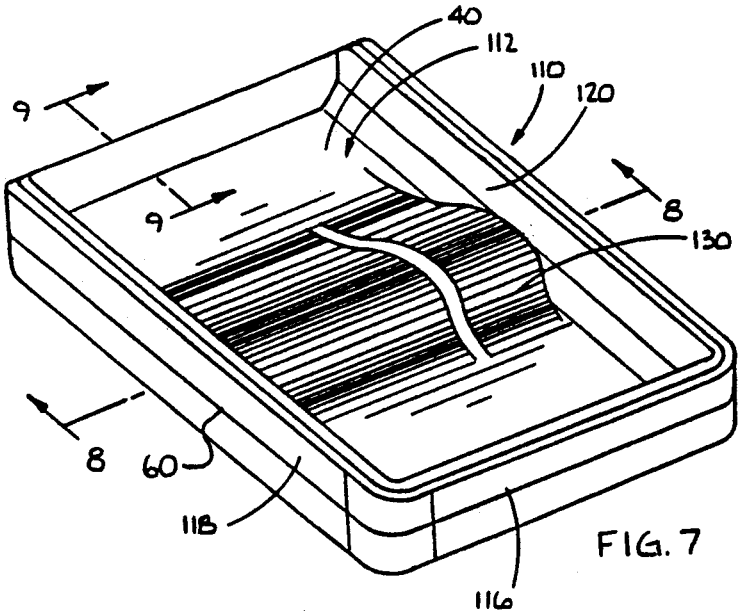
FIG. 7 is a perspective view of an alternate embodiment of the waterbed mattress liner tray including an alternate collapsible sidewall structure.
Figure 9:
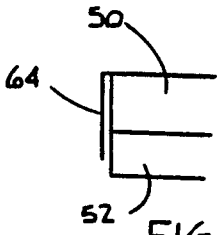
FIG. 9 is a partial side sectional view taken along line 9—9 in FIG. 7 and showing the headwall of the liner.
Figure 8:
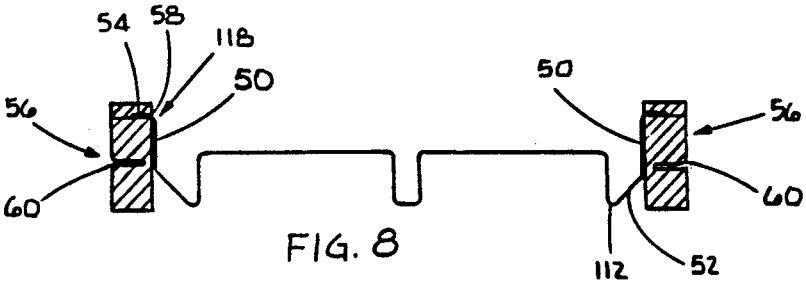
FIG. 8 is a sectional view taken along line 8—8 in FIG. 7.

Referring to FIGS. 7–9, there is shown an alternate waterbed mattress liner tray 110 which includes a bottom wall 112, headwall 114, footwall 116 and opposite sidewalls 118 and 120 which are all integrally connected together as in the prior embodiment to form an open-topped water retaining tray for a waterbed mattress. Sidewalls 118 and 120 and footwall 116, as illustrated in FIG. 8, include a generally upright upper portion 50 and an upwardly and outwardly inclined lower portion 52 which interconnects the bottom wall 112 and lower edge of the upper portion 50. The vertical extent of the lower portion is preferable between one fourth and three fourths of the vertical extent of sidewall 118. The upper edge of upper portion 50 preferably terminates in an outwardly extended flange 54.

A mechanical insulator block of a semirigid foam or any other suitable material, is extended along each sidewall 118 and 120 and footwall 116 so as to be situated at least partially below the flange 54 and adhesively secured to the adjacent upper portion 50 or otherwise secured relative to the wall that it contacts. The mechanical insulator block 56 may be sidewall 118 as illustrated in FIG. 8 and have a longitudinally extended slit 58 formed in its interior side for receiving the flange 54. The exterior surface of mechanical insulator block 56 may present another lower slit 60 for receiving the edges of bed linen to facilitate making of the bed.

It is preferred that the normal expanded height of that portion of the mechanical insulator block 56 which is below the flange 54 be generally equal to the normal expanded height of the adjacent wall so that the mechanical insulator block 56 is compressible under a downward load on the adjacent wall. The inclined lower portion 52 of either sidewall or footwall is bent downwardly by the force of a downward load to enable compression of the respective wall.

The top edge of headwall 114 preferably terminates in an upper flange folded forwardly and downwardly against the exterior surface of headwall 114 to provide a reinforced but thin headwall for the tray thereby enabling the waterbed mattress to extend toward the head end as far as possible. Thus even a tall sleeper's head will be resting on the waterbed mattress rather than the headwall 114. The length of the waterbed mattress could be further increased by forming the footwall like the headwall 114 of FIG. 9 but the soft compressible structure for the footwall 116 is preferred.

The mechanical insulator blocks 56 may be provided in elongated straight strips as illustrated in FIG. 7 with arcuate corner sections provided to underlie each corner of the tray at the foot end thereof.

Whereas the invention has been shown and described in connection with preferred embodiments thereof, it is apparent that many modifications, substitutions and additions may be made which are within the intended broad scope of the appended claims.

I claim:

1. A waterbed mattress liner tray, comprising a bottom wall, headwall, footwall and opposite sidewalls connected together to form an open-topped water retaining tray adapted for receiving and supporting a waterbed mattress on said bottom wall and between said other walls, each sidewall including at least one wall portion which is inclined at an acute angle to vertical so as to be collapsible under a downward load, and each sidewall being formed of a resilient material which expands to a normal height upon removal of a downward load.

2. The waterbed mattress liner tray of claim 1 wherein said bottom wall, headwall, footwall and opposite sidewalls are integral portions of a unitary tray.

3. The waterbed mattress liner tray of claim 2 wherein said footwall includes at least one wall portion which is inclined at an angle to vertical so as to be collapsible under a downward load.

4. The waterbed mattress liner tray of claim 1 wherein said inclined wall portion comprises a bellows-like spring including a generally pleated panel, each sidewall being collapsible from a normal expanded height to a shortened compressed height and being spring biased to the normal expanded height thereof.

5. The waterbed mattress liner tray of claim 4 wherein said pleated panel comprises a plurality of integral stacked oppositely inclined pleats integrally connected together along adjacent edges.

6. The waterbed mattress liner tray of claim 5 wherein said bellows-like spring extends vertically substantially throughout the height of said sidewall.

7. The waterbed mattress liner tray of claim 6 further comprising a mechanical insulator overlying the top edge of each sidewall and footwall and fastening means for securing each mechanical insulator in said position.

8. The waterbed mattress liner tray of claim 7 wherein each sidewall and footwall terminates at its upper edge in a generally horizontal flange, said mechanical insulator covering said flange and being attached thereto.

9. The waterbed mattress liner tray of claim 1 wherein each sidewall includes an upper portion and a lower portion, each having upper and lower edges, said inclined wall portion comprising said lower portion and extending upwardly and outwardly from said bottom wall to the lower edge of said upper portion.

10. The waterbed mattress liner tray of claim 9 wherein the vertical extent of said inclined wall portion is between one fourth and three fourths of the vertical extent of said sidewall.

11. The waterbed mattress liner tray of claim 10 wherein the upper edge of said upper portion terminates in an outwardly extended flange.

12. The waterbed mattress liner tray of claim 11 further comprising a mechanical insulator block situated at least partially below said flange and secured to said sidewall, the normal expanded height of that portion of said mechanical insulator block which is below said flange being generally equivalent to the normal expanded height of said sidewall whereby said mechanical insulator block is compressible under a downward load on said sidewall.

13. The waterbed mattress liner tray of claim 12 wherein said mechanical insulator block is formed of a foam material.

14. The waterbed mattress liner tray of claim 1 wherein said bottom wall is contoured to form at least one riser section and at least one channel extended longitudinally across the length of said riser section for drainage of water thereacross the maximum height of said riser section above said channel being a substantial portion of the normal height of each sidewall, thereby to provide added support for a sleeper in the area above said maximum height of said riser section.

15. The waterbed mattress liner tray of claim 14 wherein the portion of said bottom wall excluding said riser sections is generally planar and each channel includes a bottom surface which is generally coplanar with said generally planar portion of the bottom wall.

16. The waterbed mattress liner tray of claim 15 wherein said riser section extends transversely substantially across said bottom wall.

17. The waterbed mattress liner tray of claim 16 wherein one of said longitudinal channels are formed adjacent each sidewall between said sidewall and a riser section.

18. The waterbed mattress liner tray of claim 17 further comprising a center longitudinal channel generally transversely centered between said sidewalls.

19. A waterbed mattress liner tray, comprising a bottom wall, headwall, footwall and opposite sidewalls connected together to form an open-topped water retaining tray adapted for receiving and supporting a waterbed mattress on said bottom wall and between said other walls, said bottom wall being contoured to form at least one riser section and at least one channel extended longitudinally across the length of said riser section for drainage of water thereacross, the maximum height of said riser section above said channel being a substantial portion of the normal height of each sidewall, thereby to provide added support for a sleeper in the area above said maximum height of said riser section.

20. The waterbed mattress liner tray of claim 19 wherein said riser section extends transversely substantially across said bottom wall.

21. The waterbed mattress liner tray of claim 20 wherein the portion of said bottom wall excluding said riser sections is generally planar and each channel includes a bottom surface which is generally coplanar with said generally planar portion of the bottom wall.

22. The waterbed mattress liner tray of claim 21 wherein one of said longitudinal channels are formed adjacent each sidewall between said sidewall and a riser section.

23. The waterbed mattress liner tray of claim 22 further comprising a center longitudinal channel generally transversely centered between said sidewalls.

24. The waterbed mattress liner tray of claim 21 wherein said generally planar portion of said bottom wall has a sunken recess forming a drainage well and a closable drain opening through said well.

25. A waterbed mattress liner tray, comprising a bottom wall, headwall, footwall and opposite sidewalls connected together to form an open-topped water retaining tray adapted for receiving and supporting a waterbed mattress on said bottom wall and between said other walls, each sidewall including at least one wall portion which is inclined at an acute angle to vertical so as to be collapsible under a downward load, each sidewall being formed of a resilient material which expands to a normal height upon removal of a downward load, each sidewall including an upper portion and a lower portion, each having upper and lower edges, said inclined wall portion comprising said lower portion and extending upwardly and outwardly from said bottom wall to the lower edge of said upper portion, the vertical extent of said inclined wall portion being between one fourth and three fourths of the vertical extent of said sidewall, the upper edge of said upper portion terminating in an outwardly extended flange, a mechanical instructor block situated at least partially below said flange and secured to said sidewall, the normal expanded height of that portion of said mechanical insulator block which is below said flange being generally equivalent to the normal expanded height of said sidewall whereby said mechanical insulator block is compressible under a downward load on said sidewall, and said mechanical insulator block including a generally horizontally extended slit in the interior side thereof at a height generally corresponding to the normal expanded height of said sidewall for receiving said flange whereby said mechanical insulator block insulates the top and bottom surfaces of said flange.

26. The waterbed mattress liner tray of claim 25 wherein said mechanical insulator block further comprises an outward facing slit extended generally horizontally across the length thereof to accommodate receipt of bed linen.

* * * * *